US007100803B2

(12) United States Patent
Magermans et al.

(10) Patent No.: US 7,100,803 B2
(45) **Date of Patent: *Sep. 5, 2006**

(54) DRINK DISPENSING DEVICE AND CONTAINER FOR DRINK PROVIDED WITH POSITIONING MEANS

(75) Inventors: Marcel Peter Magermans, Den Hoorn (NL); Piet hein Willem Timp, Heemstede (NL)

(73) Assignee: Heineken Technical Services B.V., Zoeterwoude (NL)

( * ) Notice: Subject to any disclaimer, the term of this patent is extended or adjusted under 35 U.S.C. 154(b) by 0 days.

This patent is subject to a terminal disclaimer.

(21) Appl. No.: 10/297,717

(22) PCT Filed: Jun. 11, 2001

(86) PCT No.: PCT/NL01/00438

§ 371 (c)(1),
(2), (4) Date: Dec. 31, 2003

(87) PCT Pub. No.: WO01/94251

PCT Pub. Date: Dec. 13, 2001

(65) Prior Publication Data

US 2004/0099687 A1 May 27, 2004

(30) Foreign Application Priority Data

Jun. 9, 2000 (NL) ..... 1015411

(51) Int. Cl.
*B67D 5/06* (2006.01)

(52) U.S. Cl. ..... 222/183; 222/146.6; 222/325; 222/333

(58) Field of Classification Search ..... 222/183, 222/131, 172, 527, 529, 530, 146.6, 466, 222/538, 325, 333
See application file for complete search history.

(56) References Cited

U.S. PATENT DOCUMENTS

| | | | | |
|---|---|---|---|---|
| 2,104,466 | A * | 1/1938 | Marzolf | 62/166 |
| 2,792,692 | A * | 5/1957 | Reed | 62/306 |
| 3,317,089 | A * | 5/1967 | Kopezynski | 222/183 |
| 4,120,425 | A * | 10/1978 | Bethurum | 222/146.6 |
| 4,429,931 | A * | 2/1984 | Brooks | 312/228 |
| 5,540,359 | A * | 7/1996 | Gobbel | 222/174 |
| 6,041,970 | A | 3/2000 | Vogel | |
| 6,105,825 | A * | 8/2000 | Gomi et al. | 222/146.6 |
| 6,481,238 | B1 * | 11/2002 | Jennings et al. | 62/457.4 |
| 6,510,965 | B1 * | 1/2003 | Decottignies et al. | 222/95 |
| 2003/0136800 | A1 * | 7/2003 | Brand et al. | 222/183 |
| 2004/0124212 | A1 * | 7/2004 | Masuda | 222/183 |

FOREIGN PATENT DOCUMENTS

| | | |
|---|---|---|
| DE | 196 05 756 | 8/1997 |
| EP | 0 287 164 | 10/1988 |
| WO | WO 99 11563 | 3/1999 |

* cited by examiner

*Primary Examiner*—Philippe Derakshani
(74) *Attorney, Agent, or Firm*—Young & Thompson

(57) ABSTRACT

An assembly of a container (1) for drink and a drink dispensing device (11), each of which is provided with positioning elements (13,13'; 16, 16') for orientation of the air connector (20, 48) and the dispensing opening (4) of the container (1) with an air channel (22) and a dispensing line (5) in the lid (25) of the dispensing device (11).

11 Claims, 7 Drawing Sheets

DRINK DISPENSING DEVICE AND CONTAINER FOR DRINK PROVIDED WITH POSITIONING MEANS

BACKGROUND OF THE INVENTION

The invention relates to an assembly of a drink dispensing device having a chill chamber with a chamber wall and, at a top, an opening for accommodating a container containing a drink, as well as a container that is provided at a top section with a dispensing element for dispensing the drink and with a peripheral wall, as well as a drink dispensing device and container for use in such a device.

A container of this type is disclosed in International Patent Application no. WO 99/11563. In the case of the known container the flexible line is accommodated inside a cap that is fitted over an upper end face of the container. The container can have a plastic outer jacket with an internal flexible bag, containing a carbonated drink, such as beer. The container is placed in a closable chill chamber of a drink dispensing device and connected to a pressure line which feeds a pressure medium into the space between the flexible bag and the outer jacket. The flexible dispensing line is fed through a dispensing tap at the top of the chill chamber, which dispensing tap is in clamping engagement on the tube in order to close this off and releases the dispensing line by operation of a tap handle. On placing the container in the chill chamber a break seal at the top of the cap can be removed and the dispensing line can be removed from the cap in order to connect the outlet to the dispensing tap.

One disadvantage of the known container is that access to the dispenser tube via the opening in the cap is relatively difficult for the user. Furthermore, positioning of the end of the tube in the dispensing tap of the dispensing device is relatively difficult.

SUMMARY OF THE INVENTION

One aim of the invention is to provide a container with which the flexible dispensing line can be hygienically fixed on the container during storage and transport of the container and with which the line can easily be placed in the use position by a user and can be connected to a dispensing tap of a dispensing device known per se.

A further aim of the invention is to provide a container with which the flexible dispensing line can be reliably housed in the container again after use.

A further aim is to provide a container that can easily be placed with the correct orientation in a dispensing device and which can be coupled in a simple manner to the dispensing device, such as to the dispensing tap and/or to the pressure medium feed.

To this end a container according to the invention is characterised in that the container is provided with positioning means which extend transversely to the peripheral wall, the chamber wall of the chill chamber being provided with complementary positioning means which, when the container is placed in the chill chamber, engage on the positioning means of the container in such a way that the container is brought into a defined position with respect to the chill chamber.

As a result of the use of the positioning means on the container and in the chill chamber, the container can be brought into a defined position with respect to the chill chamber. In particular the positioning of the container with respect to the dispensing tap of the drink dispensing device and with respect to a pressure medium connector that is not located on a centre line of the container is facilitated by this means. The chill chamber of the dispensing device can be provided with at least two diametrically located slot-shaped, stepped wall sections, the width of which can decrease towards the base of the chill chamber. The depth of the stepped wall sections, or the distance therefrom to the centre line of the chill chamber, can also taper, so that the container can be introduced into the chill chamber relatively easily through the open top face of the essentially cylindrical dispensing device by introducing the projections into the relatively wide slots. On lowering the container into the chill chamber the walls of the constricting slots engage on the projections, so that the container acquires its correct orientation.

The projections of the container are preferably made of a relatively rigid material so that an accurately defined distance is obtained between the supporting surfaces, by means of which the projections bear on the slot-shaped stepped wall sections of the container, and the top of the container, where the pressure medium connector and an operating element for a shut-off valve of the container are located, which connector and operating element are brought into engagement with the pressure medium line and a pressure element in the lid of the container. With this accurately defined distance, which guarantees that an airtight and fluid-tight connection of the pressure medium line and the drink dispensing line is obtained in the lid when a lid of the container is closed, it is possible to use containers of different volumes, which extend to a greater or lesser extent in the vertical direction towards the base of the chill chamber.

In one embodiment the operating element for the shut-off valve of the container and the connector for connecting to the pressure medium feed in the lid are located on a line that runs essentially in a longitudinal direction of the positioning means of the container, which positioning means engage on the positioning means of the chill chamber by means of a cavity that is curved in the longitudinal direction of the positioning means of the container and that engages on a complementary curved projection of the slots in the chill chamber wall. Fine adjustment of the position of the operating element and the connector with respect to the pressure medium feed and the extraction line in the lid of the container in a direction along the line on which the connector and the operating element of the container are located takes place by this means. This ensures that a tight-fitting connection of the coupling element and the lid of the dispensing device to the container is obtained.

BRIEF DESCRIPTION OF THE DRAWINGS

A few embodiments of a container, as well as of an assembly of a container and drink dispensing device according to the invention will be explained in more detail with reference to the appended drawing. In the drawing.

DESCRIPTION OF THE PREFERRED EMBODIMENTS

Figure 1A:
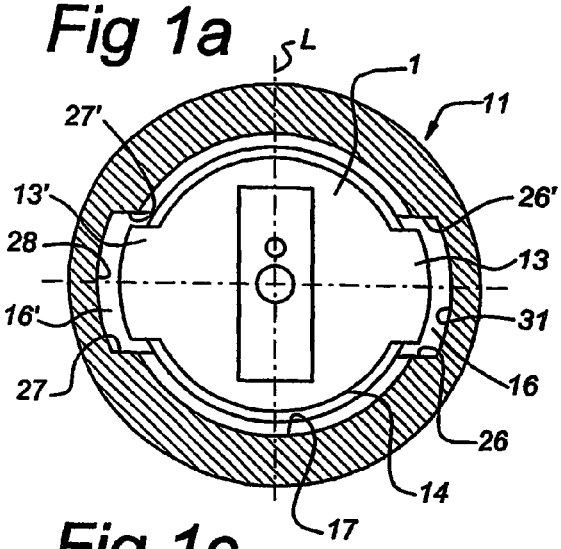
FIGS. 1*a*, 1*b* and 1*c*, 1*d* show a cross-section and, respectively, a longitudinal section of an assembly of a container and a dispensing device, according to the present invention, in a front view and a side view, respectively.
Figure 1B:
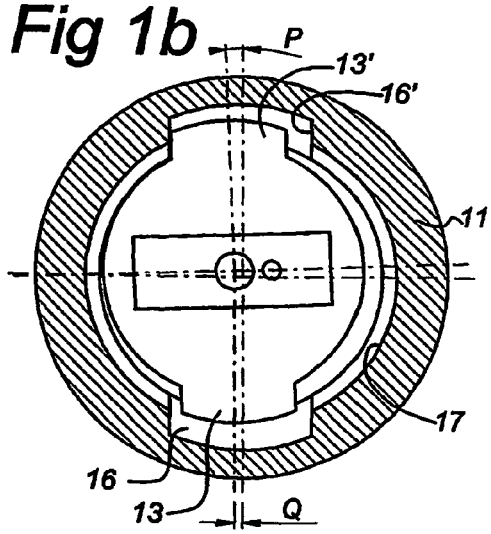
Figure 1C:
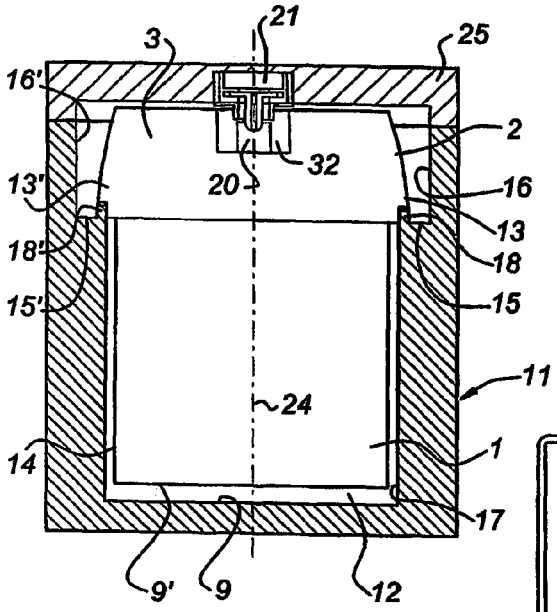

FIGS. 1*a*–1*d* show a container 1 that has been placed in a drink dispensing device 11. The container 1 is provided with a plastic outer jacket and at a top 2 has a cap 3 attached to the outer jacket. The container 1 has an outlet 4, which can clearly be seen in FIG. 1*d*. A flexible dispensing line 5 is connected to the outlet 4, which dispensing line is provided at its outlet end 6 with a shut-off valve 7 and with an outlet section 8, made of relatively rigid plastic, at right angles. The shut-off valve 7 is described in more detail in Netherlands Patent Application no. 1 015 368, which was filed on 31 May 2000 in the name of the Applicant, the contents of which are incorporated herein by reference, and engages on a dispensing tap 19 of the dispensing device 11.

The dispensing device 11 is provided with a chill chamber 12 for accommodating the container 1. The container 1 has two ears 13, 13' at its top, which ears protrude laterally with respect to the peripheral wall 14 of the container. The ears 13, 13' bear on horizontal supporting surfaces 15, 15' of stepped wall sections 16, 16' in the chill chamber wall 17. In this way the container 1 is correctly positioned with respect to the chill chamber, both in respect of height and in respect of angular position, so that the dispensing line 5 and the shut-off valve 7 can be connected to the dispensing tap 19 of the dispensing device 11. Furthermore, the ears 13, 13' assist when positioning an air inlet 20 of the container 1 with respect to a coupling element 21, arranged in the lid 25, of a pressure line 22, which pressure line is connected to a compressor 23. As can be seen from FIG. 1*b*, the coupling element 21 is located some distance from the centre line 24, next to the central outlet 4.

When placing the container 1 in the chill chamber 12 the lid 25 of the dispensing device 11 is open and the container 1 is suspended in the chill chamber 12 by bringing the ears 13, 13' to bear on the horizontal supporting surfaces 15, 15'. As a result of this suspension in the dispensing device, containers of different heights can be used, the distance between the bottom 9' of the container and a base 9 of the chill chamber 12 being able to vary, for a constant and accurately defined position of the air inlet 20 and the outlet 4.

The distance between opposing side walls 26, 26' and 27, 27' of the stepped wall sections 16, 16' can decrease towards the base of the chill chamber 12 whilst the rear walls 28, 31 of the wall sections 16, 16' can taper towards the centre line 24. As a result the container 1 can easily be placed through the top opening in the chill chamber 12 with the ears 13, 13' in the broad positioning slots and the container itself seeks its correct orientation when it is lowered into the chill chamber.

The horizontal supporting surfaces 15, 15' are provided with chamfered ridges 18, 18' which engage in cavities 29, 29' in the ears 13, 13' of the container 1. The curvature of the ridges 18, 18' is oriented in line with line L, see FIG. 1, on which the coupling element 21 for the air connector and the operating element for the spring-loaded shut-off valve of the outlet 4 are located, so that the air connector in the lid and the operating element for the valve are aligned correctly with respect to the container.

After closing the lid 25, the compressor 23 is connected to the air inlet 20 and a spring-loaded shut-off valve of the outlet 4 is pressed down by a lid component, so that the outlet is opened and drink can be dispensed from the container 1 under pressure via the dispensing tap 19 by opening and closing the shut-off valve 7 by means of a handle 10.

Figure 1D:
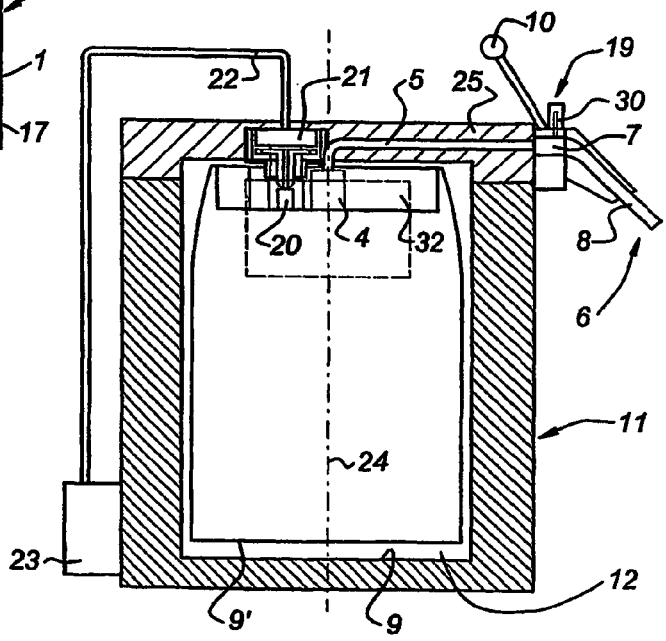
Figure 2:
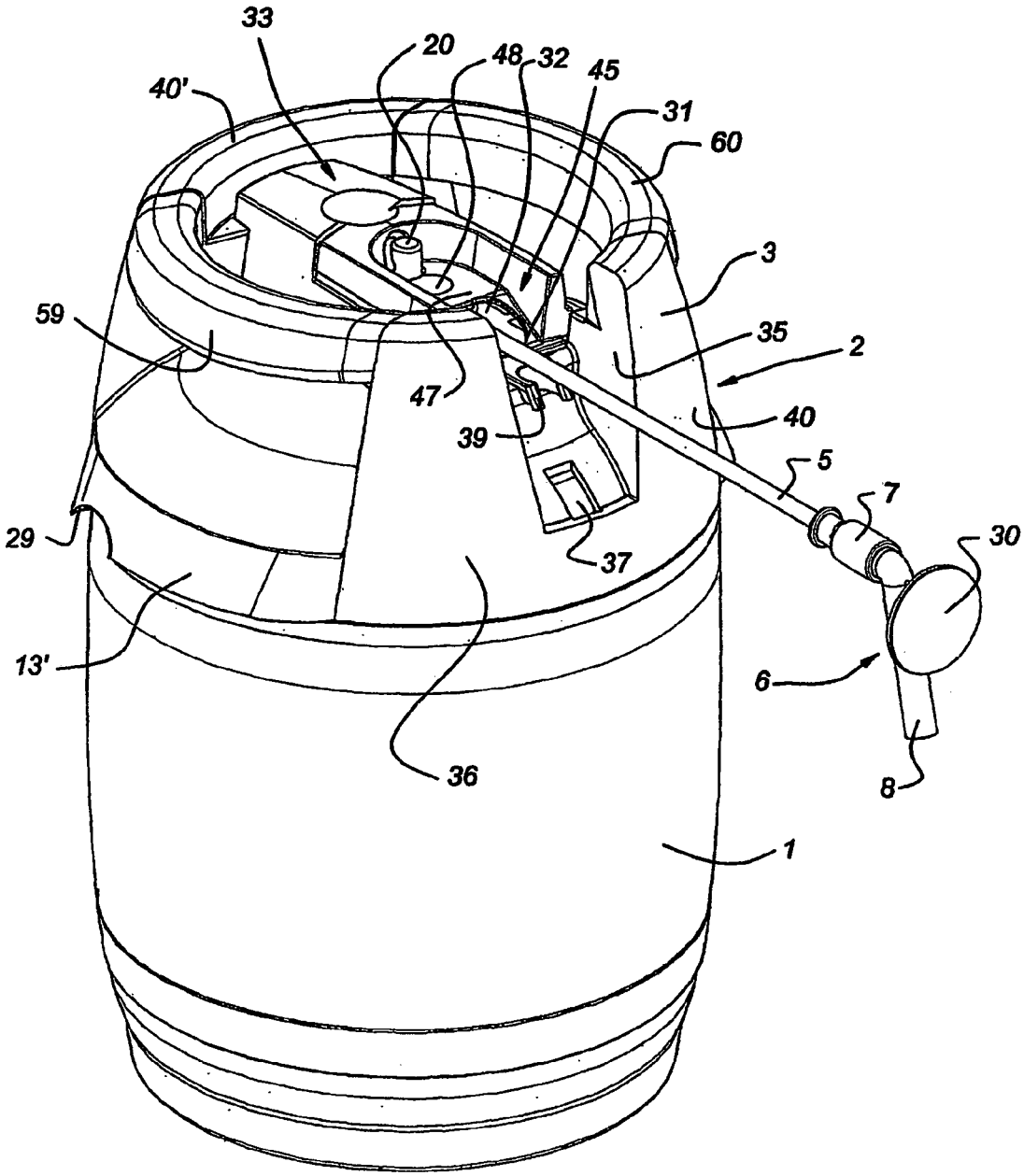
FIG. 2 shows a container according to FIG. 1 with the protective cap removed and with the dispensing line in the extended use position, it being possible for the outlet end to be fitted in a dispensing tap of the dispensing device.

FIG. 2 shows the container 1 with the dispensing line 5 in the extended position, in which the shut-off valve 7 can be connected to the dispensing tap 19. With this arrangement a plate 30 forms a grip component that can be grasped by the user and that can be placed in the dispensing tap 19 in order to position the outlet end 6 accurately in the dispensing tap 19, as is shown diagrammatically in FIG. 1*d*. The dispensing line emerges through an extraction opening 31 from chamber 32, which is accommodated in central bridge 33. The central bridge 33 is located within a peripheral wall 36 of the container that has two hand grips 59, 60, located some distance away from the bridge 33, and two wall sections 40, 40' which border the ends of the bridge 33. The dispensing line 5 is connected in the chamber 32 to the outlet 4 of the container 1. The extraction opening 31 is accessible via a cut-out 35 in the wall section 40 of the peripheral wall 36 of the cap 3 of the container. A clamping element 39, in which the outlet end 6 can be accommodated, is positioned close to the extraction opening 31, as shown in FIG. 3.

Figure 3:
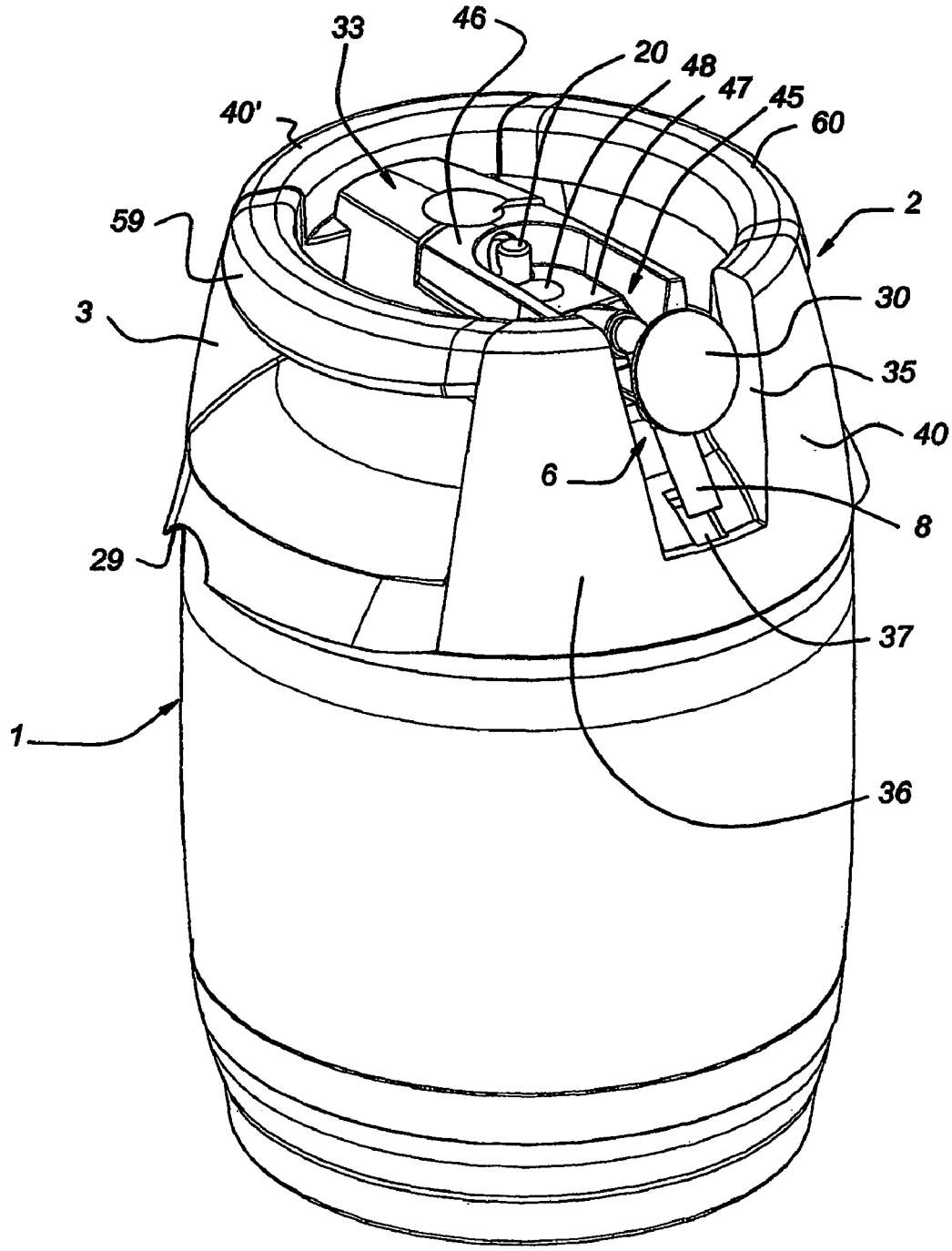
FIG. 3 shows a perspective view of the container according to FIG. 2, with protective cap removed, the dispensing line being placed in the accommodating chamber.

In the storage and transport position that is shown in FIG. 3, the dispensing line 5 is housed in the chamber 32, whilst the plate 30 is located in the cut-out 35 in the peripheral wall 36. The outlet section 8 at right angles is positioned in a slot 37. As a result the outlet end 6 is in a position that to a large extent corresponds to the position in which the outlet end 6 has to be placed in the dispensing tap 19, so that it is clear to a user how the dispensing line 5 and the outlet end 6 have to be brought into a use position that is shown in FIG. 1*d* and in FIG. 2.

In the storage and transport position as shown in FIG. 3, the outlet end 6 of the dispensing line 5 is located in a second compartment 45 that is delimited by the surface of the cut-out 35 in the peripheral wall 36 of the cap 3 and by a top face 46 of the central bridge 33. In the second compartment 45 the air connector 20 extends through a top wall 47 of the chamber 32 so that this can be connected to the coupling element 21 in the lid 25 of the dispensing device. Via an opening 48 in the top wall 47 the lid 25 is able on closing to engage, for example via the coupling element 21, on an operating element 51 (see FIG. 4) for opening the outlet 4. The second compartment 45 can be closed off by a removable protective cap or lid 52, as shown in FIG. 4 and FIG. 5.

Figure 4:
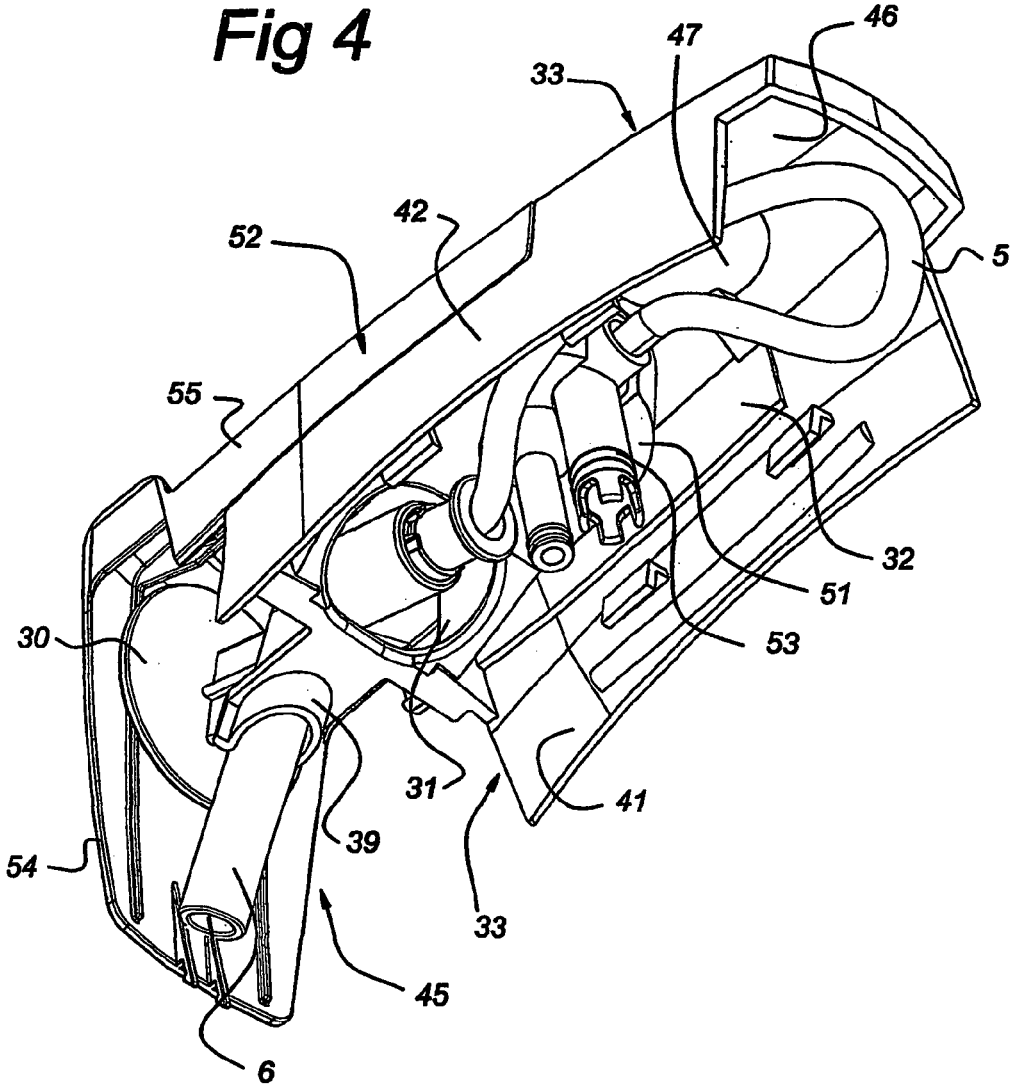
FIG. 4 shows a perspective bottom view of a central bridge, with the accommodating chamber for the dispensing line.

FIG. 4 shows a perspective bottom view of the central bridge 33, side walls 41, 42 and the top wall 47 of which delimit the chamber 32. A tube section 53 at right angles is fitted on the end of the dispensing line 5 and, when the operating element 51 is pressed down, engages on a spring-loaded shut-off valve for the outlet 4. To this end, when the lid is closed, part of the lid 25 of the dispensing device extends through the top wall 47 of the chamber 32.

Figure 5:
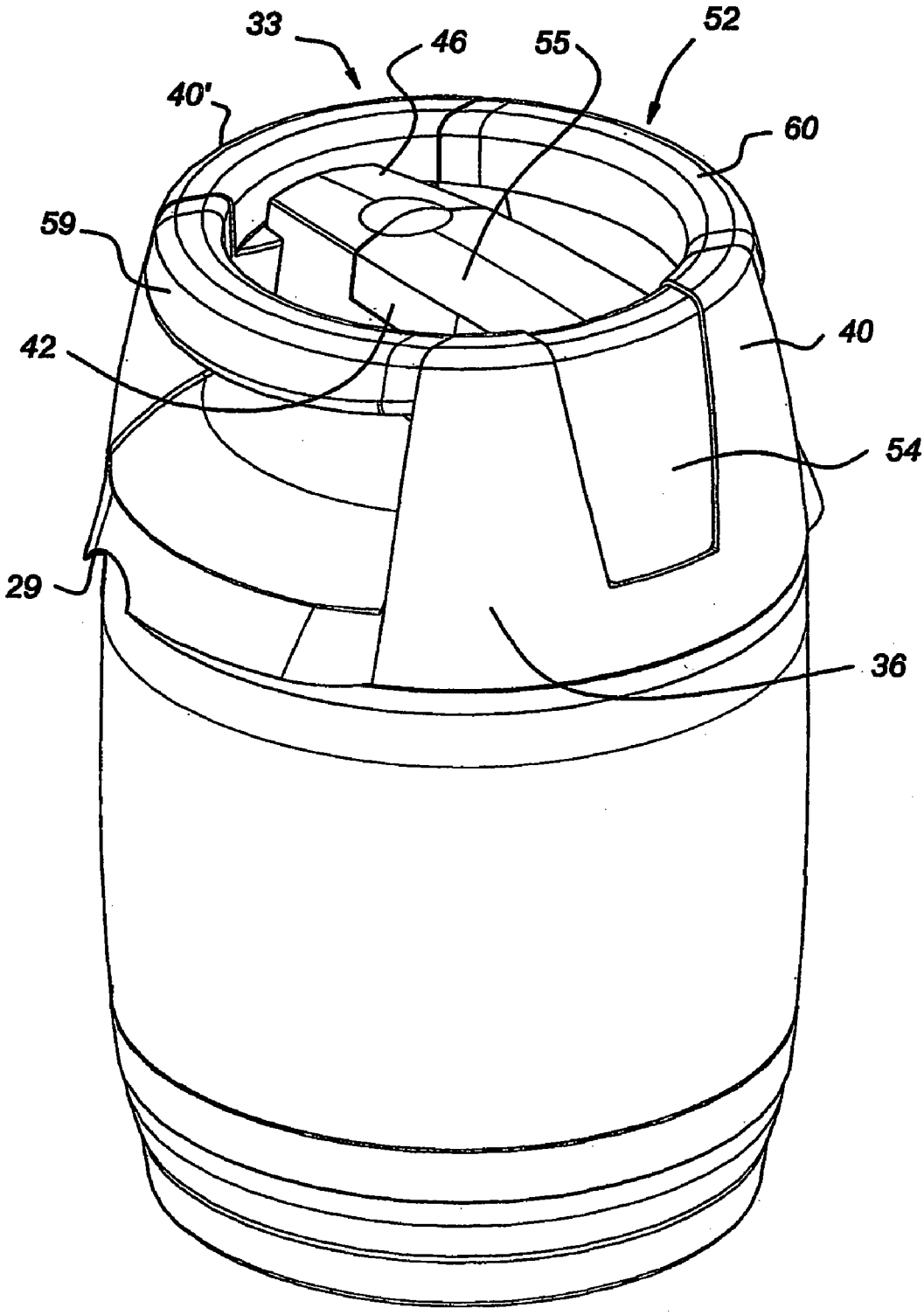
FIG. 5 shows a container according to FIG. 3 with the protective cap fitted, in the storage and transport position.

As shown in FIG. 5 the second compartment 45 is covered by the lid 52, the lid having two sections 54, 55 at right angles which are essentially coincident with the plane of the peripheral wall 36 and with a top face 46 of the central bridge 33.

Figure 6:
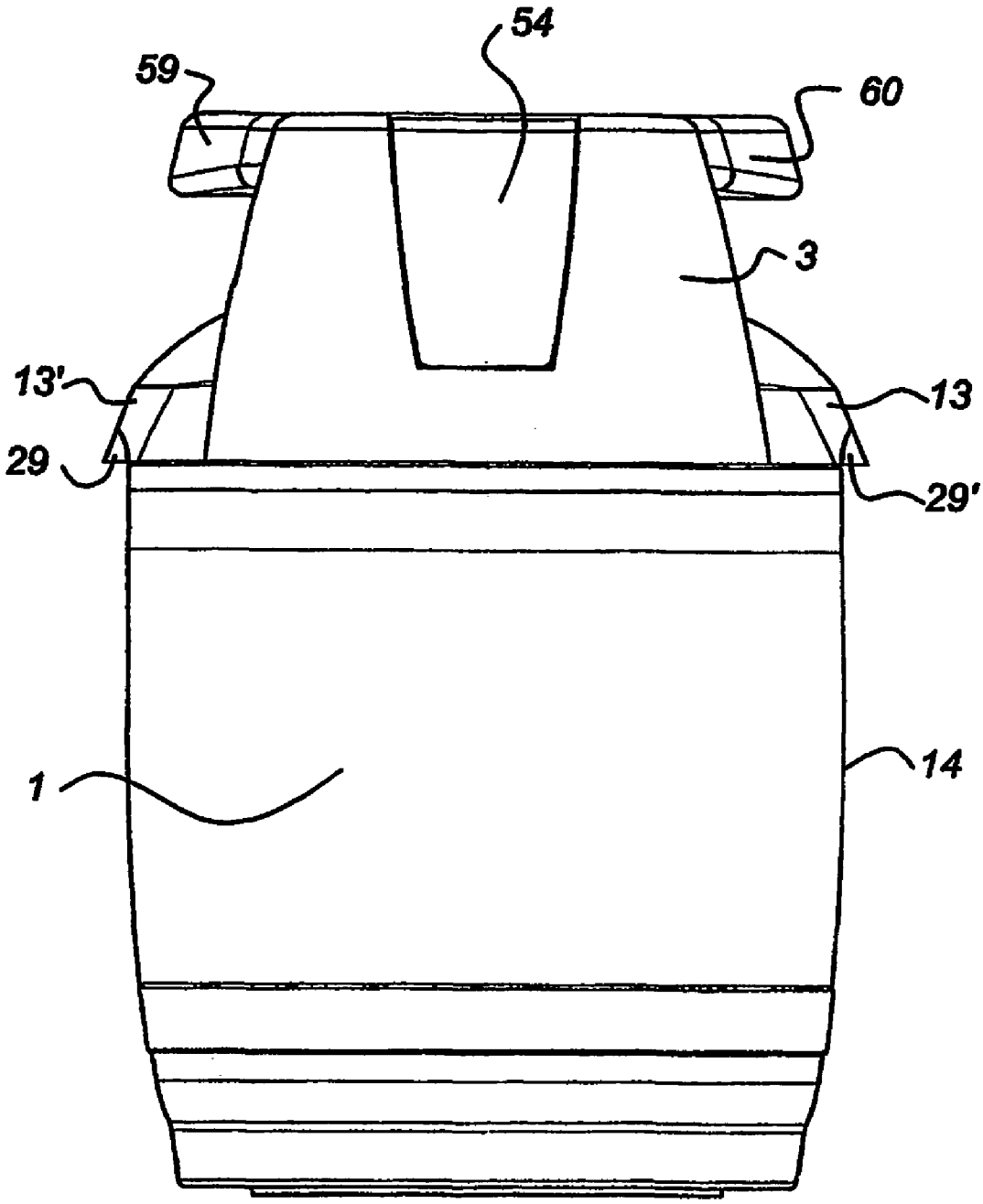
FIG. 6 shows a side view of a container according to the invention provided with positioning ears.

FIG. 6 shows a side view of the container 1, provided with the two ears 13, 13', projecting laterally beyond the peripheral wall 14, and with two hand grips 59, 60, located on either side of central bridge 33, which can be used by a user to lift the container 1 and place it in the dispensing device.

Figure 7:
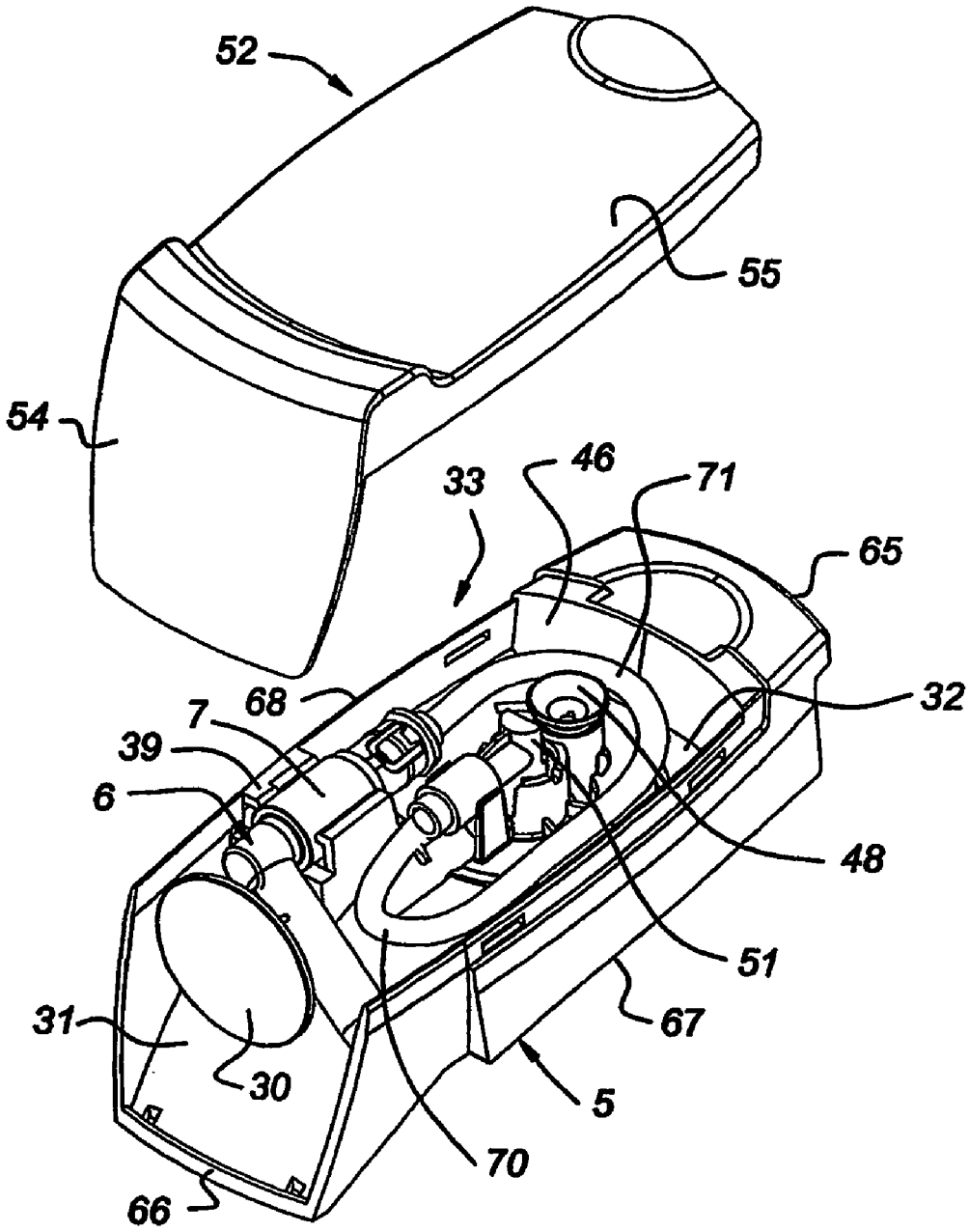
FIG. 7 shows a perspective view of a chamber with the flexible dispensing line constructed as an integral unit.

FIG. 7 shows a central bridge 33 that is constructed as an integral unit with the flexible dispensing line 5, the operating element 51 and air connector 48. Corresponding components in FIG. 7 are provided with the same reference numerals as in FIGS. 2–6. The flexible dispensing line 5 extends from the operating element 51 towards the front short side 66 of the bridge 33. The dispensing line 5 then runs via a first bend 70 along a long side 67 of the bridge 33 and extends via a second bend 71 around the air connector 48, which is in line with the operating element 51. The dispensing line 5 runs further from the rear short side 65 of the bridge 33 to the front short side 66 via the second long side 68 of the bridge 33. The outlet end 6 is held in place by the clamping element 39 close to the open short side 66 of the chamber 32. The chamber 32 is closed off by the L-shaped lid 52. The arrangement shown can be efficiently assembled by machine, permanent deformation in the dispensing line 5 as a result of kinking or folding double being prevented. After removal of the lid 52, the gripper component 30 is in a position that is easily accessible for the user and that corresponds to the position in which the outlet end 6 has to be fitted in the dispensing device.

The bridge 33 according to FIG. 7, that is constructed as an integral unit, can be clicked into the mid section of the top 2 of the container so that the opening 31 in the chamber is coincident with the cut-out 35 in the wall section 40 and is closed off by the short section 54 of the lid 52.

The connector or opening 48 and the operating element 51 are placed in the correct position with respect to the lid 25 of the dispensing device 11, viewed in the longitudinal direction of the central bridge 33, by means of the cavities 29, 29' in the ears 13, 13'.

The invention claimed is:

1. Assembly of a drink dispensing device (11) having a chill chamber (12) with a chamber wall (17), an opening for accommodating a container (1) containing a drink, and a pressure medium feed (21), as well as a container (1) that is provided at a top section (2) with a dispensing element (4,5,6,7) for dispensing the drink, with a connector (20,48) for detachably connecting to the pressure medium feed (21) upon placing and removing of the container (1) into and from the chill chamber (12), wherein the connector is located in a fixed angular position on the container outside a center line of the container, and with a peripheral wall (14), the container being provided with positioning means (13,13') which extend transversely to the peripheral wall (14), the chill chamber (12) being provided with complementary positioning means (16,16') which, when the container is placed in the chill chamber (12), engage on the positioning means (13, 13') of the container, the positioning means and the complementary positioning means together defining an angular position of the container about the center line in which the connector (20, 48) is aligned with the pressure medium feed (21), wherein by engagement of the positioning means (13,13') on the container with the complementary positioning means (16,16'), the connector (20,48) is brought in a defined attachment position with the pressure medium feed (21) upon introduction of the container (1) in the chill chamber (12).

2. Assembly according to claim 1, wherein the positioning means (13, 13') of the container comprise at least two projections extending transversely to the peripheral wall, the complementary positioning (16, 16') of the dispensing device comprising at least two chamber wall sections stepped in the radial direction for accommodating the protruding projections.

3. Assembly according to claim 1, wherein, on placing the container in the chill chamber, the positioning means (13, 13') of the container bear in a vertical direction on an essentially horizontal stop surface (15, 15') of the complementary positioning means (16, 16') of the dispensing device, a bottom (9') of the container (1) being located some distance above a base (9) of the chill chamber (12).

4. Assembly according to claim 1, wherein the positioning means (13, 13'; 16, 16') of the container and of the dispensing device are arranged close to the top (2) of the container and of the chill chamber.

5. Assembly according to claim 1, wherein the complementary positioning means (16, 16') of the dispensing device comprise at least two slots having a width greater than the width of the positioning means (13, 13').

6. Assembly according to claim 5, wherein the slots taper in the direction from the center line (24) towards the base of the chill chamber (12), sloping towards the center line.

7. Assembly according to claim 1, wherein the container (1) is provided at the top (2) with an operating element (51) for a shut-off valve of the container (1), the operating element (51) and the connector (20, 48) being located on a line (L) that runs essentially in a longitudinal direction of the positioning means (13, 13') of the container, which positioning means (13,13') engage on the complementary positioning means (16, 16') of the dispensing device, by means of a cavity (29, 29') curved in the longitudinal direction of the positioning means, the positioning means (16, 16') being provided with a complementary projection (18, 18').

8. Container (1) according to claim 1, wherein the positioning means (13, 13') of the container comprise at least two projections protruding transversely to a peripheral wall of the container, the complementary positioning means (16, 16') of the dispensing device comprising at least one recess for accommodating the protruding projections.

9. Container (1) according to claim 8, further comprising an operating element (51) for a shut-off valve of the container (1), the operating element (51) and the connector (20, 48) being located on a line (L) that runs essentially in a longitudinal direction of the positioning means (13, 13') of the container, which positioning means (13,13') engage on the complementary positioning means (16, 16'), by means of a cavity (29, 29') curved in the longitudinal direction of the positioning means, the positioning means.

10. A combination of a drink dispensing device and a drink container, said drink dispensing device comprising a chill chamber in which said drink container is located, and a pressure medium feed;

said drink container comprising a drink dispensing element, and a connector that is detachably connected to said pressure medium feed, said connector being located in a fixed angular position on said drink container spaced from a center line of said drink container; and said chill chamber and said drink container each having respective positioning means for angularly positioning said drink container in said chill chamber so that said connector is aligned in an attachment position with said pressure medium feed.

11. The combination of claim 10, wherein said positioning means comprises stepped wall sections on opposite sides of an interior periphery of said chill chamber and ears that extend from opposite sides of said drink container, said ears engaging said stepped wall sections to angularly position said drink container in said chill chamber.

* * * * *